United States Patent [19]

Bohg et al.

[11] Patent Number: 4,527,139

[45] Date of Patent: Jul. 2, 1985

[54] ELECTROMAGNETIC RAM ACTUATOR

[75] Inventors: Armin Bohg, Weil-Neuweiler; Kurt Hartmann, Calw-Heumaden; Horst Matthaei, Waldenbuch, all of Fed. Rep. of Germany

[73] Assignee: International Business Machines Corporation, Armonk, N.Y.

[21] Appl. No.: 615,498

[22] Filed: May 30, 1984

[30] Foreign Application Priority Data

Jun. 1, 1983 [EP] European Pat. Off. ..... 83105444.0

[51] Int. Cl.[3] ..... H01F 7/08

[52] U.S. Cl. ..... 335/256; 335/259

[58] Field of Search ..... 335/256, 258, 259, 264, 335/265, 266, 267, 268

[56] References Cited

U.S. PATENT DOCUMENTS

| | | | |
|---|---|---|---|
| 3,275,964 | 9/1966 | Kumm | 335/259 |
| 3,503,022 | 3/1970 | Burdett | 335/256 |
| 4,371,857 | 2/1983 | Bohg et al. | 335/259 |
| 4,412,197 | 10/1983 | Bohg et al. | 335/256 |

FOREIGN PATENT DOCUMENTS

| | | | |
|---|---|---|---|
| 837276 | 4/1952 | Fed. Rep. of Germany | 335/296 |
| 1489691 | 5/1969 | Fed. Rep. of Germany | 335/296 |
| 1397007 | 3/1965 | France | 335/234 |
| 1542785 | 9/1967 | France | 335/234 |

*Primary Examiner*—George Harris
*Attorney, Agent, or Firm*—E. Ronald Coffman

[57] ABSTRACT

A high-speed reciprocating actuator, of the type used as a print hammer in high-speed printers or for operating valves or the like, is made more compact and efficient by the arrangement of a stator yoke. The stator yoke provides a series of aligned magnetic gaps that cooperate with armature bars contained in a reciprocating ram member. These gaps are made part of a plurality of independent flux conducting loops. One or more activating coils pass through each of the loops to induce magnetic flux when ram actuation is desired.

4 Claims, 11 Drawing Figures

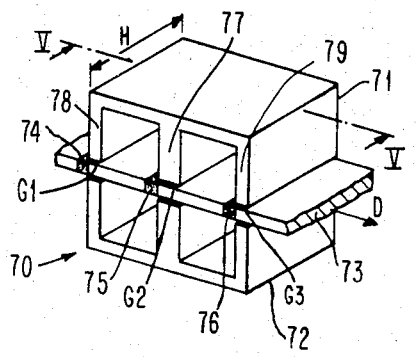
FIG. 4
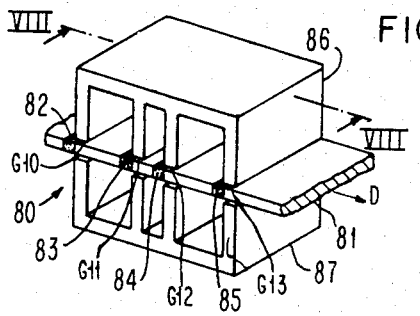
FIG. 7
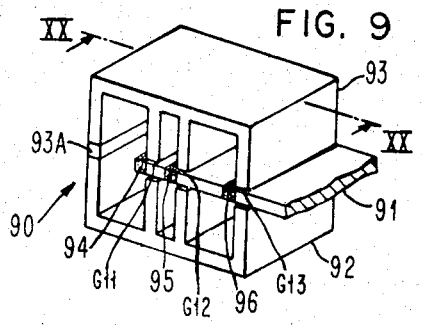
FIG. 9
FIG. 11
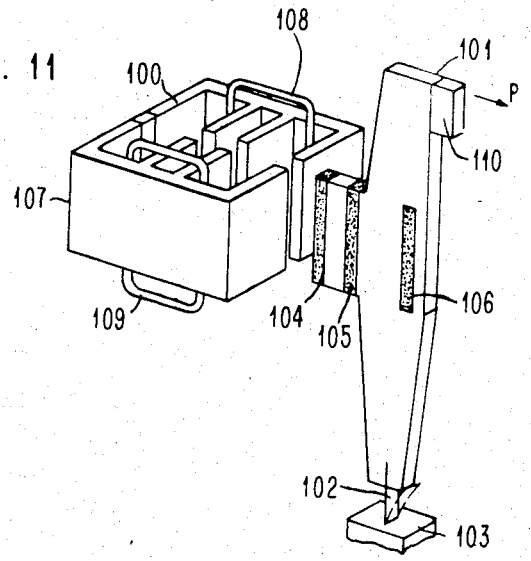

ELECTROMAGNETIC RAM ACTUATOR

FIELD OF THE INVENTION

This invention relates to the field of electromagnetic ram actuators, particularly actuators of the type used as print hammers in high speed printing devices.

BACKGROUND OF THE INVENTION

U.S. Pat. No. 4,371,857 describes a ram actuator having a movable ram member which includes a series of spaced apart magnetizable sections or inserts. The ram member is movably supported within a yoke structure that provides a series of gaps between opposed magnetic poles for cooperating with the magnetizable inserts of the ram member. An electrical coil arrangement on the yoke is activatable to generate magnetic flux through the yoke and its pole pieces to interact with the magnetizable sections of the ram member to produce a rapid acceleration of the ram member as an output stroke. The underlying principles of operations of such an actuator are described in connection with FIG. 6 of that patent.

U.S. Pat. No. 4,412,197 describes a ram actuator similar to that of U.S. Pat. No. 4,371,857, but wherein the electromagnetic yoke structure comprises a pair of yoke halves of the E shaped cross section, wherein the three legs of the E provide the gap-forming poles. The activating coil is supplied as a prewound toroidal body that is shaped to fit over the center leg of the E and be confined within the space between the center leg and the two outer legs. This arrangement contributes to the compactness and ease of assembly of the ram actuator.

It is an object of the present invention to provide a ram actuator having a compact geometry suitable for assembly into a multi-actuator bank and having easy to install toroid-like coils similar to those described in U.S. Pat. No. 4,412,197, but having enhanced electromagnetic efficiency.

Another object of this invention to provide a ram actuator that can achieve an electromagnetic actuating force equal to that produced by the arrangement of U.S. Pat. No. 4,371,857 with a smaller more compact structure.

SUMMARY OF THE INVENTION

This invention employs a magnetic yoke structure providing a plurality of gap-forming legs similar to that of U.S. Pat. No. 4,412,197 but not having an E shaped cross section, as described therein. Instead, the yoke is arranged to provide a sufficient number of legs together with the interconnecting magnetic material that at least two separate magnetic flux conducting loops are provided. A flat toroid like coil of compact and easy to assemble construction is formed to provide a span which passes through each of the two magnetic flux conducting loops. By this arrangement gaps formed between the stator legs can each be made to operate with maximum effectiveness.

These and other objects features and advantages of this invention will be understood from the following description of several preferred embodiments, wherein differences made to the accompanying drawings, of which:

FIG. 1 is an exploded perspective view of a print ram actuator of the type shown in U.S. Pat. No. 4,412,197.

FIG. 4 is a simplified assembled perspective view of a magnetic yoke and ram member of the type used in the ram unit of FIG. 1.

FIG. 7 is a simplified schematic assembled view of a magnetic yoke and ram member constructed in accordance with this invention.

FIG. 9 is a simplified schematic assembled view of a modified yoke and ram member constructed in accordance with this invention.

FIG. 11 is a simplified perspective view of a print hammer arm or a ram unit constructed according to FIG. 9, but wherein the ram member is formed on a pivoted hammer arm.

Figure 1:
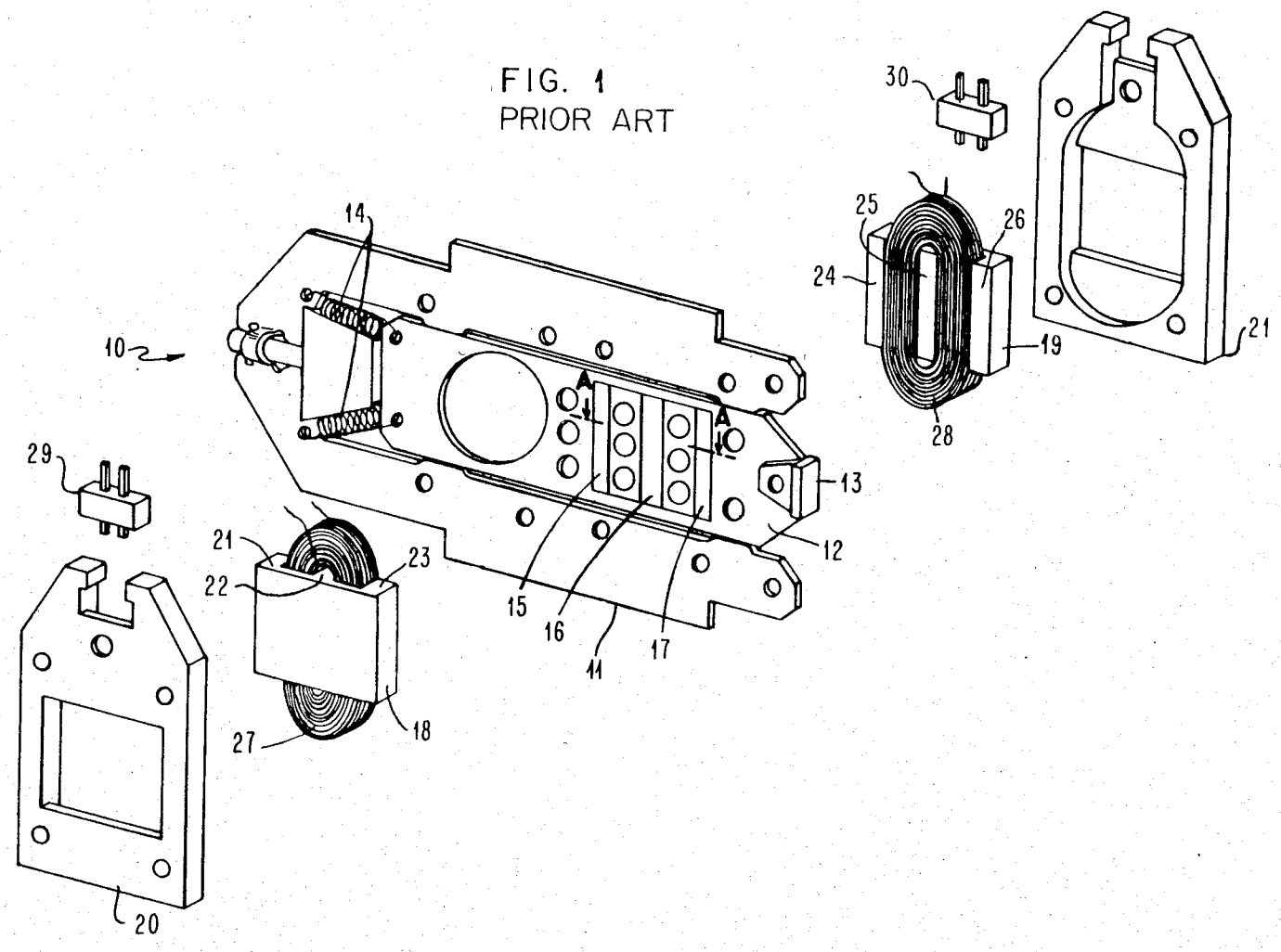
FIG. 1 PRIOR ART

FIG. 1 shows the general arrangement of a print ram unit 10 of the type described in U.S. Pat. No. 4,412,197. This unit comprises a track forming frame 11, which movably supports a tongue shaped ram member 12 having a ram face 13, which for example can impact a type element not shown for printing action. Springs 14 yieldably hold the ram member 12 in its rest position. Ram member 12 includes soft iron armature bars 15, 16, and 17. These bars are suitably supported in an otherwise lightweight, e.g., plastic body forming the ram member 12. A magnetic yoke or stator structure for cooperating with the armature bars 15, 16 and 17 is provided by a pair of magnetically permeable yoke halves 18 and 19 which are supported adjacent the ram member 12 by respective mounting blocks 20 and 21. Each of the yoke halves 18 and 19 have an E shaped cross section which provides a series of three operating gaps for cooperation respectively with armature bars 15, 16, and 17. Thus in the rest position of ram member 12, each of the bars 15, 16 and 17 is positioned adjacent and offset to the left of a respective gap. Yoke half 18 thus includes legs 21, 22, and 23, which oppose and form operating gaps respectively with legs 24, 25, and 26 of yoke half 19.

A compact, easy-to-assemble, toroid-like activating coil 27, is assembled into the space between legs 21, 22, and 23 of yoke half 18. This coil is compact in that it does not extend outwardly from the yoke half 18 in the direction normal to the direction of movement of ram unit 12. Further, the coil can be formed separately from the yoke half 18 and assembled on the yoke half by simple insertion over the center leg 22. A similar coil 28 is provided for yoke half 19. Coils 27 and 28 are connected through external coil connectors 29 and 30 to a suitable activating electrical power source.

Figure 2:
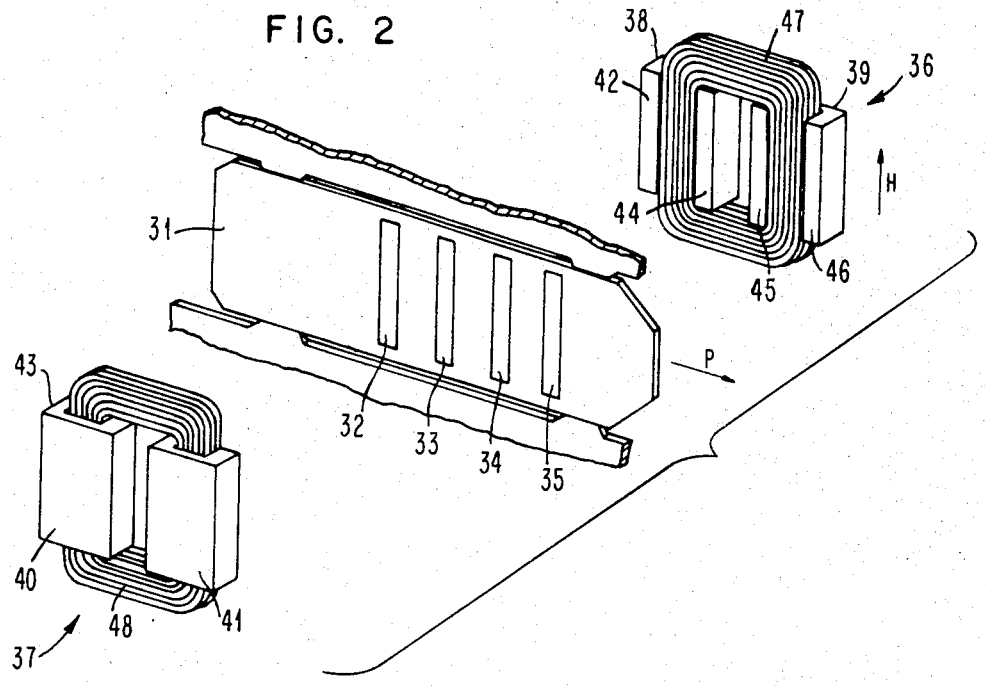
FIG. 2 is a simplified perspective exploded view of a print ram unit having a yoke and coil structure arranged according to this invention, but otherwise having construction details like those shown in FIG. 1.

FIG. 2 shows an electro-magnetic ram actuator otherwise constructed like that of FIG. 1, but employing a modified magnetically permeable yoke and modified ram member 31 in accordance with this invention. Ram member 31 includes four soft iron armature bars 32, 33, 34 and 35 which cooperate respectively with four aligned gaps provided by yoke portions 36 and 37. In the embodiment of FIG. 2, the yoke portions 36 and 37 are provided by separate magnetically permeable sections 38, 39, 40 and 41 respectively. Thus the gap for cooperating with armature bar 32, is provided by leg 42 of yoke section 38 and leg 43 of yoke section 40. The gap for cooperating with armature bar 33 is provided by leg 44 of section 38 and the opposed leg of section 40. The gap for cooperating with armature bar 34 and 35 are provided respectively by the legs 45 and 46 and the opposing legs provided by section 41.

Toroid-like activating coils 47 and 48 are assembled through the space between the legs of each of the yoke section 38, 39, 40, and 41. As hereinafter more fully explained, each pair of opposing yoke sections, for example sections 38 and 40, provide a magnetic flux loop that is independent of the loop provided by the other pair of opposed yoke sections 39 and 41. The turns of coils 47 and 48 pass through both of these flux conducting loops. This arrangement permits the weight of the ram unit 31, including armature bars 32 through 35, to be reduced while achieving an enhanced print capacity for the same electrical excitation i.e. ampere turns of the activating coil. Thus, for a given height H of a ram unit as shown in FIG. 2, the same number of ampere turns of the respective activating coils will produce about 40% less force in the arrangement of FIG. 1 than will be produced in an arrangement like FIG. 2. Conversely, it is possible to reduce the height H of the arrangement of FIG. 2 compared to that of FIG. 1 by about 25% while achieving the same active force on the ram member 31. By reducing the overall height, and hence the weight of ram member 31, a smaller mass is achieved which will experience a greater acceleration by the same force and thus, an additional increase in printing capacity is obtained.

Figure 3:
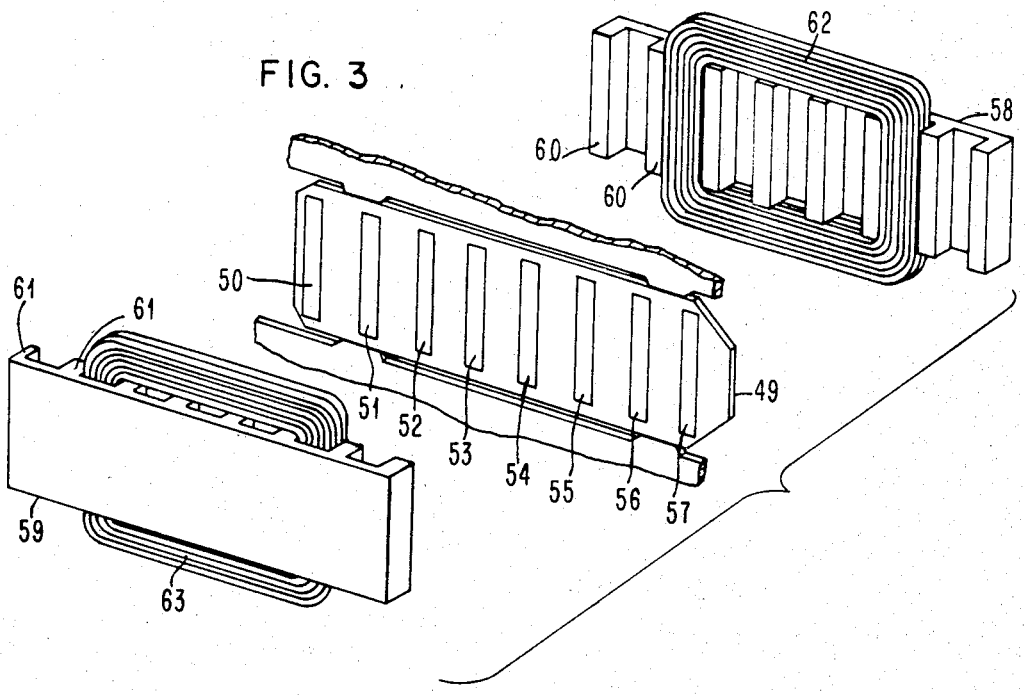
FIG. 3 is a simplified perspective exploded view similar to FIG. 2 but showing a different yoke and coil arrangement constructed in accordance with the invention.

FIG. 3 shows a further embodiment of this invention. Ram member 49 is provided with eight armature bars 50–57. Yoke halves 58 and 59 each provide a plurality of inwardly opposing legs 60 and 61 respectively, which cooperate with each of the armature bars 50–57 in a manner analogous to that described in connection with FIG. 2. Pre-formed toroid-like activating coils 62 and 63 include spans that pass between spaced legs 60 of yoke half 58 and legs 61 of yoke half 59 respectively. Compared with the arrangement of FIG. 1, the arrangement of FIG. 3 also permits a considerably reduced overall height of the print ram, since the entire force active on the print ram is increased by having a larger number of magnetic operating gaps. Thus the arrangement of FIG. 2, permits the reduction of the overall height of the actuator by about 50% with respect to that of the arrangement shown in FIG. 1.

Figure 5:
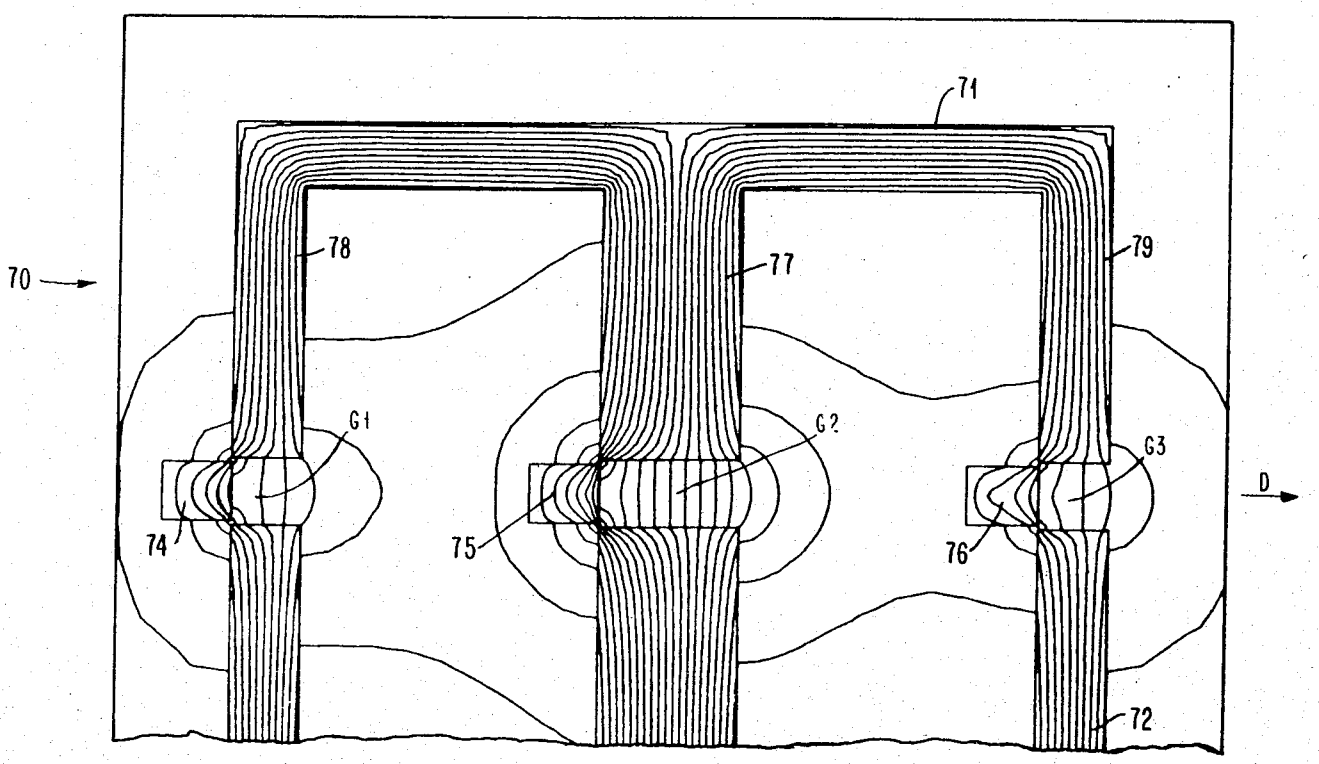
FIG. 5 is a plot of magnetic flux lines superimposed on a partial cross sectional diagram of a yoke and ram member of the type shown in FIG. 4.
Figure 6:
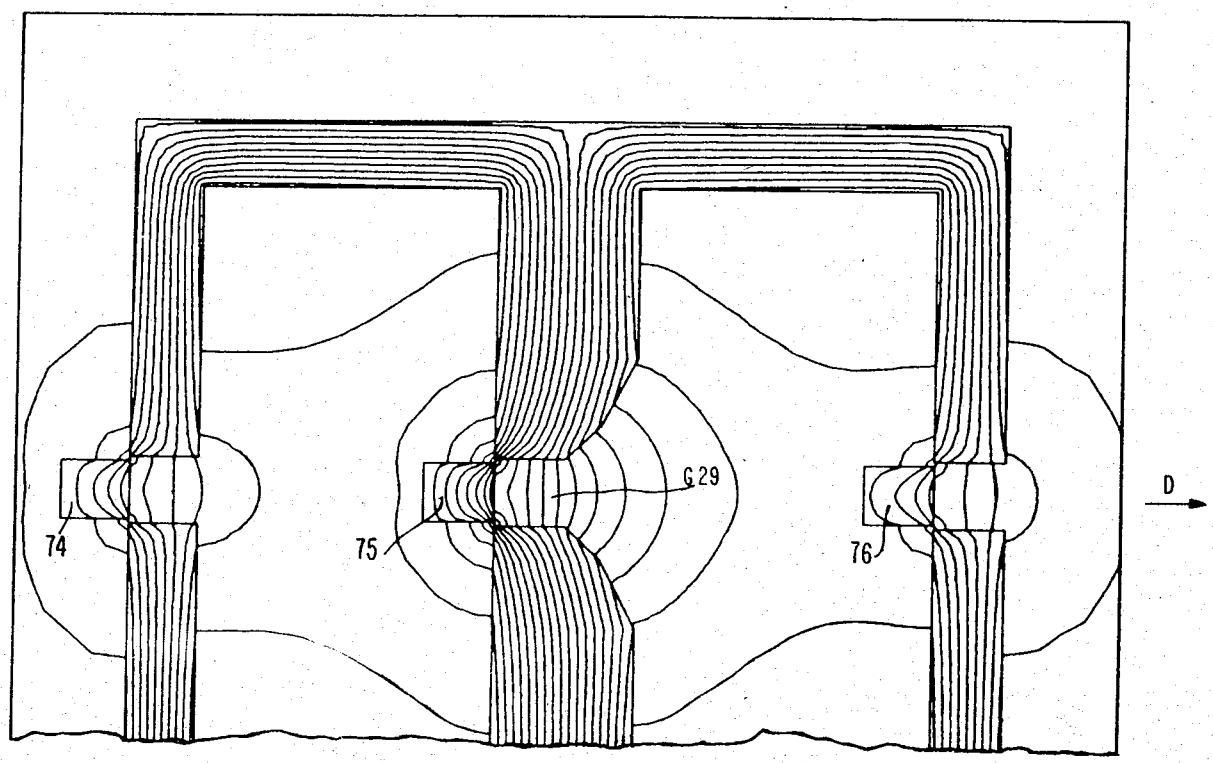
FIG. 6 is a plot of magnetic flux lines superimposed on a partial cross sectional diagram of a yoke and ram member of the type shown in FIG. 4, not having a modified central leg portion.
Figure 8:
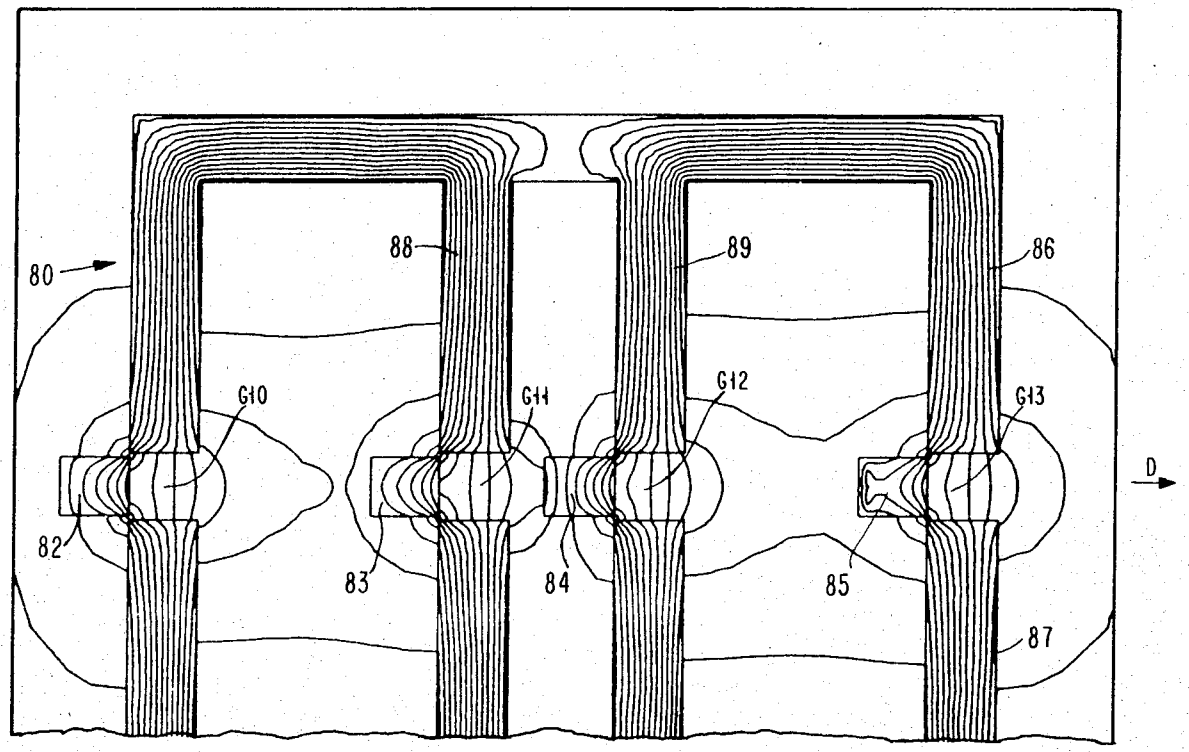
FIG. 8 is a plot of magnetic flux lines superimposed on a partial cross sectional diagram of a yoke and ram member of the type shown in FIG. 7.

An explanation of how the active force is increased for a given number of ampere turns of the excitation coil, by increasing the number of operating gaps is provided through use of the simplified perspective yoke constructions shown in FIGS. 4 and 7 together with associated descriptions of magnetic flux paths provided by such arrangements as illustrated in FIGS. 5, 6, and 8.

FIG. 4 shows an actuator construction 70 that is conceptually like that of actuator 10 in FIG. 1, in that yoke halves 71 and 72 are provided with an E shaped cross section. Ram member 73 includes armature bars 74, 75, and 76 that cooperate with gaps G1, G2, and G3, provided by respective legs of the yoke halves 71 and 72. Note particularly from FIG. 5, that the center leg 77 of yoke half 71 is twice as thick as the outer yoke legs 78 and 79. This added thickness is required to prevent the magnetic saturation of the central leg 77 which must can carry all of the flux generated in both outer legs 78 and 79. Similarly, gap G2 provided by the thicker leg 77 is broader than gaps G1 and G3. However, armature bar 75 associated with gap G2 can effectively be only of the same size as armature bars 74 and 76, since all of the armature bars are capable of passing through only the same operating stroke, which must begin with the armature bars positioned outside of the their respective gaps, as illustrated in FIG. 5.

FIG. 6 shows a modified form of E shaped yoke structure wherein the center leg is tapered to provide a gap of smaller breadth which might be expected to provide a greater number of flux lines available for attracting the adjacent armature bar. As shown in FIG. 6, such configuration does not increase the number of flux lines available to interact with the center armature bar 75 over that available in the configuration of FIG. 5.

FIG. 7 shows a simplified perspective view of a ram actuator 80 constructed in accordance with this invention. Actuator 80 includes a ram member 81 carrying four armature bars 82, 83, 84, and 85, which respectively cooperate with aligned gaps G10, G11, G12 and G13, provided by the legs of respective yoke halves 86 and 87.

FIG. 8 shows the flux pattern provided by this arrangement. Thus, it can be seen that FIG. 8, that the undesirable asymmetry inherent in the three leg structure of either FIGS. 5 or 6, is eliminated with the four leg structure illustrated in FIG. 8. By dividing the central leg of the three leg structure conceptually into two separate legs to achieve the four leg structure of FIGS. 7 and 8, to provide two separate flux loops intersected by the gaps G10, G11, G12 and G13, a considerable increase in the available accelerating force acting on the armature bars is achieved. Note that in connection with the arrangement of FIG. 8, there is an interaction between the gap G11 and armature bar 84, which retards the action of gap G12 on armature bar 84. It has been found that the spacing between the center leg when increased, provides only a slightly higher accelerating force than an arrangement with a smaller spacing. Calculations and tests have shown that a structure with four legs constructed in accordance with FIGS. 7 and 8 activated by 600 ampere turns of the exciting coil, yields the same accelerating force as a structure with three legs constructed in accordance with FIG. 5, activated by 800 ampere turns. This means that for a structure with four legs (FIG. 8) the $I^2R$ losses (I=current, R=Ohmic resistance) are reduced to 56% of that experienced in the arrangement of FIG. 5. For applications with a high repetition rate of the print process, the accelerating force acting on the ram in a four leg arrangement (FIG. 8) is 40% higher for the same number of ampere turns as a structure with three legs (FIG. 5).

Figure 10:
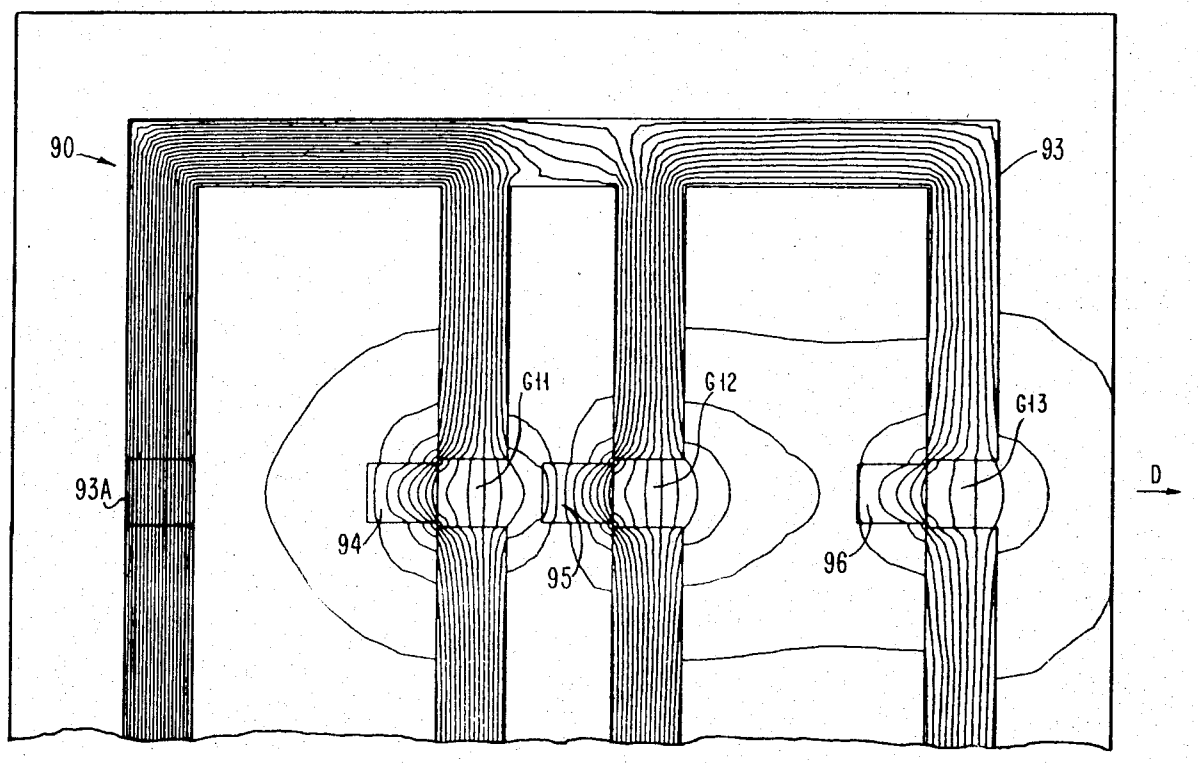
FIG. 10 is a partial cross sectional diagram of a yoke and ram member of the type shown in FIG. 9, illustrating the pattern of magnetic flux lines such an arrangement would produce.

FIG. 9 shows a modified ram arrangement 90. Ram member 91 and yoke structure 92, 93 are similar to the arrangement shown in FIG. 7, except that gap G10 of FIG. 7 has been eliminated by the inclusion of a magnetic bridging member 93A and only three armature bars 94, 95, and 96 are provided in ram member 91. This arrangement allows the overall length of ram member 91 to be reduced, thereby increasing its reciprocation repetition rate. As seen from FIG. 10, the increase in the flux conducting efficiency produced by elimination of gap G10 contributes to a higher flux density available at gap G11 compared to that of FIG. 8, thereby, at least partially compensating for the absence of the fourth armature bar.

FIG. 11 shows an actuator 100, similar to actuator 90 of FIG. 9, in a partially exploded perspective view as arranged to actuate a print hammer or ram member 101. Print hammer 101 is pivotly supported by a leaf spring 102 extending from base 103. Leaf spring 102 normally holds print hammer 101 in a rest position where armature bars 104, 105 and 106 are positioned adjacent respective gaps in the yoke structure 107. Activation of coils 108 and 109, shown schematically, pivots print hammer 101 clockwise executing a print movement in the direction P of hammer face 110. The fact that hammer movement is a pivotal movement which deviates slightly from a linear movement does not have any noticeable adverse effect.

While the invention has been described in connection with an actuator particularly for use in connection with printers, can be beneficially applied as well to other high speed actuations such as, high speed valve actuations in internal combustion engines, hammer drills, pumps etc.

We claim:

1. An electromagnetic ram actuator comprising magnetically permeable yoke means providing a plurality of pairs of interconnected symmetrical legs forming at least two separate magnetic flux conducting loops, a plurality of aligned gaps intersecting said loops, a ram member movably supported in said aligned gaps, means yieldably urging said ram member to a rest position, said ram member comprising a body carrying a plurality of magnetically permeable armature bars which in said rest position are adjacent to and offset from respective ones of said gaps, and an activating coil having a plurality of turns that pass through both of said loops.

2. An electromagnetic ram actuator, as defined in claim 1, further comprising, a second activating coil, the first said activating coil being positioned on one side of said aligned gaps, and said second activating coil being positioned on the other side of said aligned gaps.

3. An electromagnetic ram actuator, as defined in claim 1, wherein said yoke means comprises two yoke halves, each providing two pairs of said symmetrical legs, and wherein said activating coil is toroid-like in shape and passes between the legs of each pair of one of said yoke halves.

4. An electromagnetic ram actuator, as defined in claim 1, wherein the movable support for said ram member comprises pivot means.

* * * * *